US007280436B2

(12) United States Patent
Pedersen

(10) Patent No.: US 7,280,436 B2
(45) Date of Patent: Oct. 9, 2007

(54) MINIATURE ACOUSTIC DETECTOR BASED ON ELECTRON SURFACE TUNNELING

(75) Inventor: Michael Pedersen, Bethesda, MD (US)

(73) Assignee: Corporation for National Research Initiatives, Reston, VA (US)

( * ) Notice: Subject to any disclaimer, the term of this patent is extended or adjusted under 35 U.S.C. 154(b) by 347 days.

(21) Appl. No.: 11/119,739

(22) Filed: May 3, 2005

(65) Prior Publication Data

US 2005/0249041 A1 Nov. 10, 2005

Related U.S. Application Data

(60) Provisional application No. 60/568,691, filed on May 7, 2004.

(51) Int. Cl.
*H04R 1/00* (2006.01)

(52) U.S. Cl. ..... 367/178

(58) Field of Classification Search ..... 367/178; 438/53

See application file for complete search history.

(56) References Cited

U.S. PATENT DOCUMENTS

| | | | | |
|---|---|---|---|---|
| 5,752,410 | A * | 5/1998 | Bernstein | 73/514.18 |
| 6,936,524 | B2 * | 8/2005 | Zhu et al. | 438/53 |
| 6,943,448 | B2 * | 9/2005 | Gabriel et al. | 257/758 |
| 7,146,016 | B2 * | 12/2006 | Pedersen | 381/175 |
| 7,195,945 | B1 * | 3/2007 | Edelstein et al. | 438/48 |
| 7,202,101 | B2 * | 4/2007 | Gabriel et al. | 438/53 |
| 2002/0067663 | A1 * | 6/2002 | Loeppert et al. | 367/181 |
| 2003/0133588 | A1 * | 7/2003 | Pedersen | 381/423 |
| 2005/0249041 | A1 * | 11/2005 | Pedersen | 367/179 |
| 2006/0210106 | A1 * | 9/2006 | Pedersen | 381/355 |
| 2006/0215858 | A1 * | 9/2006 | Pedersen | 381/191 |
| 2007/0003082 | A1 * | 1/2007 | Pedersen | 381/191 |

FOREIGN PATENT DOCUMENTS

| | | | |
|---|---|---|---|
| WO | WO9963652 | A1 * | 12/1999 |
| WO | WO 3047307 | A2 * | 6/2003 |

* cited by examiner

*Primary Examiner*—Daniel T Pihulic
(74) *Attorney, Agent, or Firm*—Nixon & Vanderhye p.c.

(57) ABSTRACT

An electronic surface tunneling acoustic detector or microphone with very high sensitivity is disclosed. A tunneling tip is mounted on a rigid perforated suspension plate, along with control electrodes, which are used to move a conductive membrane suspended above the suspension plate into closer or farther proximity with the tunneling tip. An electrical potential between the control electrodes and membrane, causing the membrane to bend towards the electrodes, and hence the tip, due to electrostatic attraction. As the membrane is pulled toward the tunneling tip, at some point a tunneling current begins to flow in the tunneling tip. The control voltage is subsequently adjusted to achieve a steady-state tunneling current in the tip. As the membrane responds to differential acoustic pressure variations, it moves and therefore upsets the adjusts the control voltage to return the membrane to the steady-state condition. As a result, the adjustment of the control voltage is a direct measure of any sound pressure incident upon the membrane.

22 Claims, 8 Drawing Sheets

MINIATURE ACOUSTIC DETECTOR BASED ON ELECTRON SURFACE TUNNELING

CROSS-REFERENCE TO RELATED APPLICATION

This application claims the benefit of Provisional Application Ser. No. 60/568,691, filed May 7, 2004, the entire contents of which is hereby incorporated by reference in this application.

FIELD OF THE INVENTION

The present invention relates to acoustic detectors and microphones, and in particular, to a microphone with very high sensitivity, in which the detection mechanism is based on electron surface tunneling.

BACKGROUND OF THE INVENTION

Electron surface tunneling is a well known phenomenon. It is predicted by quantum mechanical theory, and is exploited in surface tunneling microscopes (STM) capable of distinguishing individual atoms on surfaces. The quantum theory of surface tunneling focuses on the possibility that an electron can jump from the electron cloud on the surface of one material to an electron cloud on the surface of another material. An important feature is that the two materials are physically separated by a "forbidden" region in which free electrons are not allowed to exist. Examples of materials for such a forbidden region are electrical insulators, a vacuum, and dry air. An electron can only survive for a very short time in the "forbidden" region. If an electron makes it across the region, it is said to have "tunneled" through the region.

A basic prior art experiment 10 which demonstrates surface tunneling is shown in FIG. 1. In this experiment, there is a conducting surface 11 and a conducting tip 12, which is brought into very close proximity to the conducting surface 11. An electrical potential difference v is applied between the tip 12 and surface 11, which creates an electrical potential difference across a forbidden region 14. The potential difference helps increase the chance that an electron 13 in the tip 12 can make the jump across region 14 to the surface 11. The tunneling of the electrons 13 gives rise to an electrical current i between the tip 12 and surface 11 called "the tunnel current". To understand what is happening in this experiment, one must use quantum theory to find wave function solutions that satisfy Schrödinger's equation with the boundary conditions for the three regions (i.e., tip, forbidden region, and surface). If the Wentzel, Kramer, and Brillouin ("WKB") approximation is used, which makes certain simplified assumptions about the wave function solutions, and if it is further assumed that the tip 12 and surface 11 are made of the same material, and that the electrons 13 are distributed according to the Fermi statistics, Simmons formalism can be used to derive a tunneling current density given by:

$$J_{tunnel} = \left(\frac{e}{4\pi^2 \hbar d^2}\right)\left\{\left(\Phi_0 - \frac{eV}{2}\right)\exp\left[-\frac{2d}{\hbar}\left(2m_e\left(\Phi_0 - \frac{eV}{2}\right)\right)^{\frac{1}{2}}\right] - \left(\Phi_0 + \frac{eV}{2}\right)\exp\left[-\frac{2d}{\hbar}\left(2m_e\left(\Phi_0 + \frac{eV}{2}\right)\right)^{\frac{1}{2}}\right]\right\}. \quad (1)$$

It is important to realize from equation (1) that there is an exponential dependence between the tunneling current i and the distance d from the tip 12 to the surface 11. Therefore, even minute changes in distance d will lead to a significant change in the tunneling current i. In FIG. 2, the dependence of the tunneling current i on the distance d is shown for the prior art experiment of FIG. 1 with a gold tip 12 and surface 11, an electrical potential of 2 V, and an assumed tip area of 20 $nm^2$. As can be seen in FIG. 2, the tip 12 must be brought very close to the surface 11 to achieve a measurable tunnel current; however, even a change of distance d of 1 Å (less than half the diameter of an atom) will change the tunneling current i by a factor of 10.

Bringing the tip 12 in such close proximity to the surface 11 and maintaining its distance d without touching the surface 11 presents a tremendous control problem. A large scale "equivalent" of this control problem would be to drive a car at 60 mph up to a wall and stopping without hitting the wall, such that the bumper is less than 0.1" from the wall. With the use of micro electro mechanical systems (MEMS) technology, it has become possible to realize prior art devices, such as device 20, shown in FIG. 3, in which a very sharp tip 21 is attached to a suspension cantilever 22 with built-in actuator 23 that can move the tip 21 with extremely small amplitudes. The tip 21 and cantilever 22 are normally attached to a larger structure 24 that can be moved with conventional actuators to bring the tip 21 within about 1 micron of the surface 25 (~2000 times larger than the needed distance). The actuators 23 on the cantilever 22 are then engaged, while constantly monitoring the tunnel current i, until the specified tunnel current is achieved.

One approach for realizing a microphone 30 using a tunneling tip 31 is shown in FIG. 4. In this case, MEMS technology is used to fabricate a sensitive membrane 35, which will deflect due to an acoustic sound pressure incident on membrane 35. By using MEMS technology for the assembly, a structure 34 with a few microns initial distance between the membrane 35 and the tip 31 can be realized, which means only the actuators 33 of cantilever 32 are needed to control the tip movement. The control circuit of the actuator 33 is used in a feedback loop to maintain a certain tunnel current, and as the membrane 35 deflects, the actuator signal is changed to maintain the tunnel current, and hence the tip distance. The actuator signal therefore becomes the microphone output signal of microphone 30.

There are a number of problems with this basic structure. First, the fabrication of such a MEMS structure is very complicated and difficult to realize. The result would be that the cost of the device would be exceedingly high when compared to other microphone technologies. Second, the cantilever 32 will have a significant sensitivity to vibration, due to its inertial mass, which will manifest itself as an artifact in the microphone signal. The vibration sensitivity will be much higher for this structure than other comparable microphone structures based on other detection methods (e.g., piezoelectric or capacitive). In addition, the resonance frequency of the cantilever tip 31 is bound to fall within the frequency range of interest in the microphone 30, which will make control of the tip deflection extremely difficult or impossible.

It is therefore an object of the present invention to realize a novel structure based on MEMS technology, in which the fabrication of a tunneling tip and pressure sensitive membrane is integrated to lower the fabrication cost of the device.

It is another object of the present invention to reduce the vibration sensitivity of the tunneling microphone to a level comparable to other MEMS microphone detection technologies.

It is a further object of the present invention to design the tunneling microphone structure such that a wide acoustic bandwidth can be achieved.

SUMMARY OF THE INVENTION

The present invention is an electron surface tunneling microphone in which a tunneling tip is integrated with a pressure sensitive membrane on a single support substrate. The tunneling tip is mounted on a rigid perforated suspension plate that is fabricated on the support substrate. As a result, the vibration sensitivity of the microphone is reduced to that of the membrane. Also included on the suspension plate are at least one, and preferably a plurality of control electrodes, which are used to move the membrane into close proximity to the tunneling tip. Movement of the membrane relative to the tunneling tip is controlled by applying an electrical potential between the control electrodes and the membrane, causing the membrane to bend towards the electrodes, and hence the tip, due to electrostatic attraction. The perforated suspension plate includes a number of openings to allow air in the gap between the membrane and suspension plate to escape, and thereby reduce viscous damping and associated noise in the microphone.

The materials for the tunneling tip and control electrodes are preferably metals that will not react with the ambient in which the microphone is placed. Such metals include gold, platinum, and palladium. The pressure sensitive membrane is preferably made of a similar metal, but can be reinforced with a dielectric or semi-conducting material for mechanical support. Reinforcement materials preferably include silicon, polycrystalline silicon, silicon nitride, and silicon dioxide. Preferably, the support substrate and perforated tip suspension plate are made from materials such as silicon, silicon nitride, and silicon dioxide.

In operation, an electrical potential $V_m$ is applied between the conductive membrane and the control electrodes on the rigid suspension plate. In addition, another electrical potential is applied between the tunneling tip and the conductive membrane and the electrical current through the tunneling tip is monitored. As the membrane is pulled towards the tunneling tip, at some point a tunneling current will begin to flow in the tunneling tip. The control voltage $V_m$ is subsequently adjusted to achieve a steady-state tunneling current in the tip. As the membrane responds to differential acoustic pressure variations, it moves, and therefore upsets the steady-state tunneling current. In a feedback loop, the control voltage is instantly adjusted to return the membrane to the steady-state condition. As a result, the constant adjustment of the control voltage is a direct measure of any sound pressure incident on the membrane.

DETAILED DESCRIPTION OF THE INVENTION

The present invention is an electron surface tunneling microphone with very high sensitivity in which a tunneling tip is integrated with a pressure sensitive membrane on a single support substrate.

Figure 5:
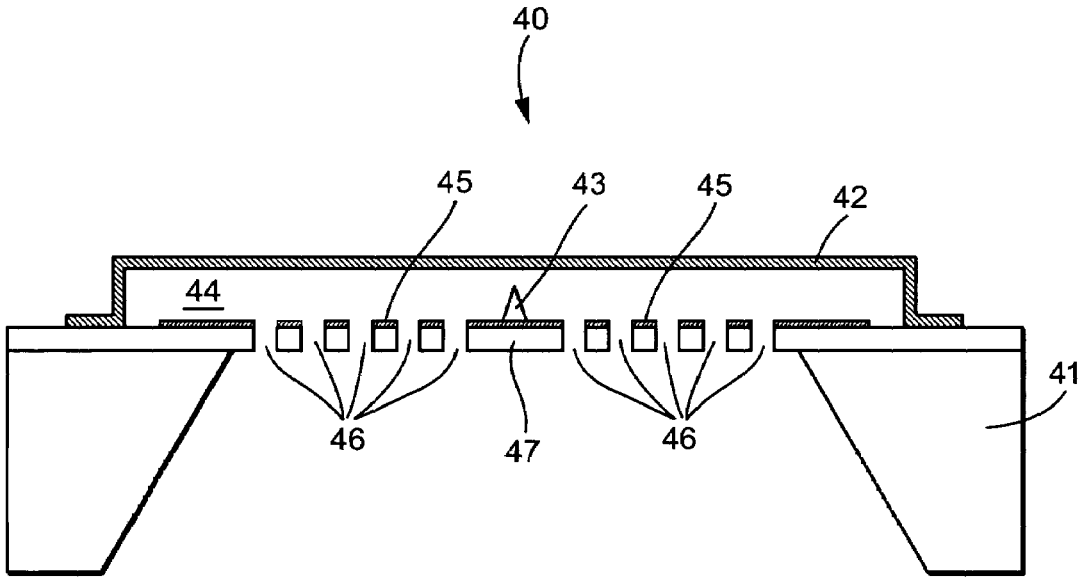
FIG. 5 is a cross-sectional diagram of the electron tunneling microphone structure of the present invention.

A preferred embodiment of the electron surface tunneling microphone structure 40 of the present invention is shown in FIG. 5. As shown in FIG. 5, a tunneling tip 43 is placed on a single support substrate 41, where it is mounted on a rigid perforated suspension plate 47. As a result, the vibration sensitivity of the microphone is reduced to that of membrane 42. Suspended above plate 47, in a manner similar to other comparable microphone structures, is a thin flexible membrane 42. Also included on the suspension plate 47 are at least one, and preferably a plurality of control electrodes 45, which are used to move the conductive membrane 42 into close proximity with the tunneling tip 43. Movement of membrane 42 relative to tunneling tip 43 is achieved by applying an electrical potential between the control electrodes 45 and membrane 42, causing membrane 42 to bend towards the electrodes 45, and hence the tip 43, due to electrostatic attraction. Suspension plate 47 is perforated by a number of openings 46 to allow air in a gap 44 between the membrane 42 and the suspension plate 47, to escape, thereby reducing viscous damping and associated noise in the microphone 40.

Preferably, tunneling tip 43 and control electrodes 45 are made from metals that will not react with the ambient in which the microphone 40 is placed. Such metals preferably include gold, platinum, and palladium. The pressure sensitive membrane 42 is preferably made of a similar metal, but can be reinforced with a dielectric or semi-conducting material for mechanical support. Reinforcement materials preferably include silicon, polycrystalline silicon, silicon nitride, and silicon dioxide. The support substrate 41 and perforated tip suspension plate 47 preferably are made from materials such as silicon, silicon nitride, and silicon dioxide.

Figure 1:
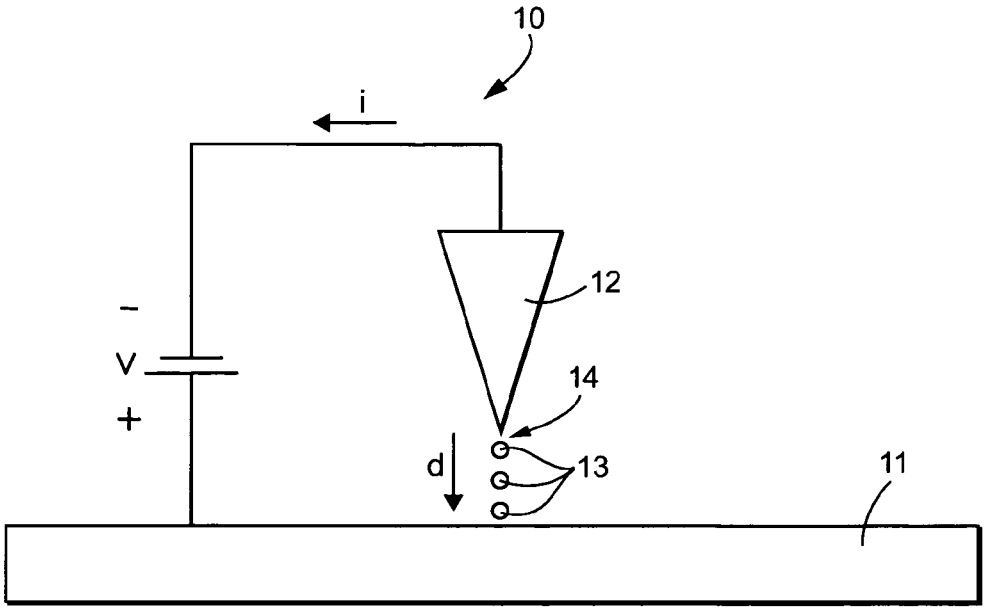
Fig. 1 (Prior Art)
FIG. 1 shows a prior art arrangement for a basic surface tunneling experiment.
Figure 2:
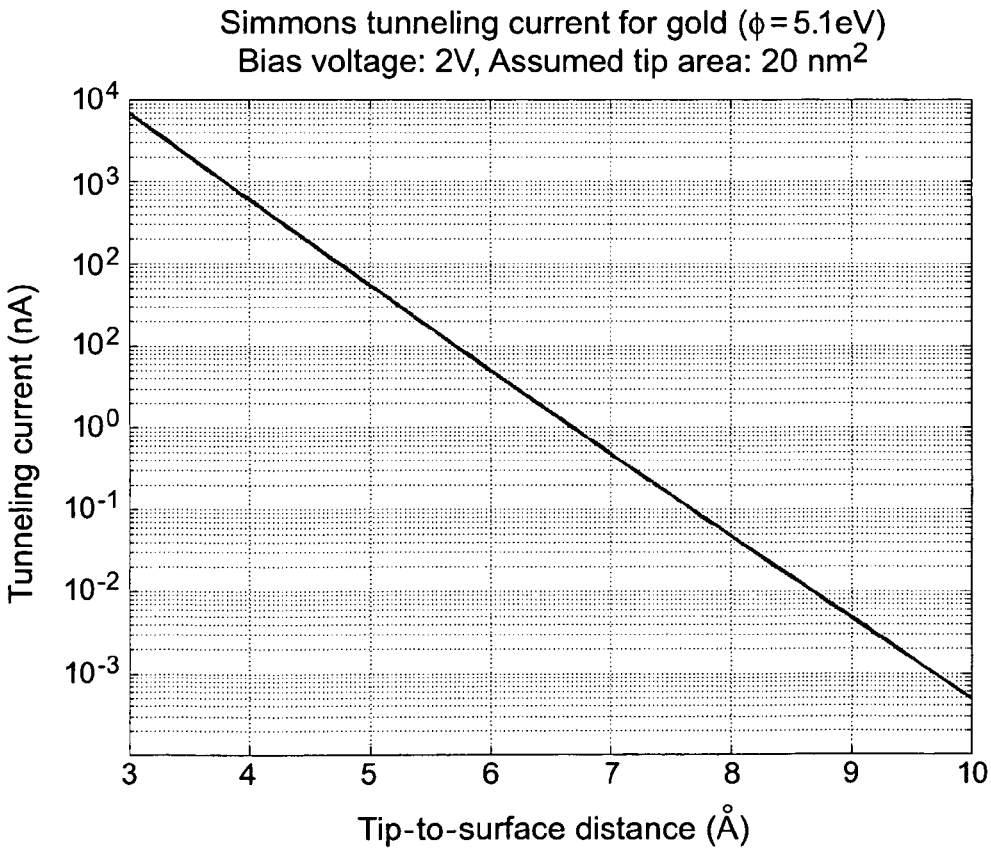
Fig. 2 (Prior Art)
FIG. 2 is a graph showing approximate tunnel current versus tip-to-surface distance for a gold tip and surface.
Figure 3:
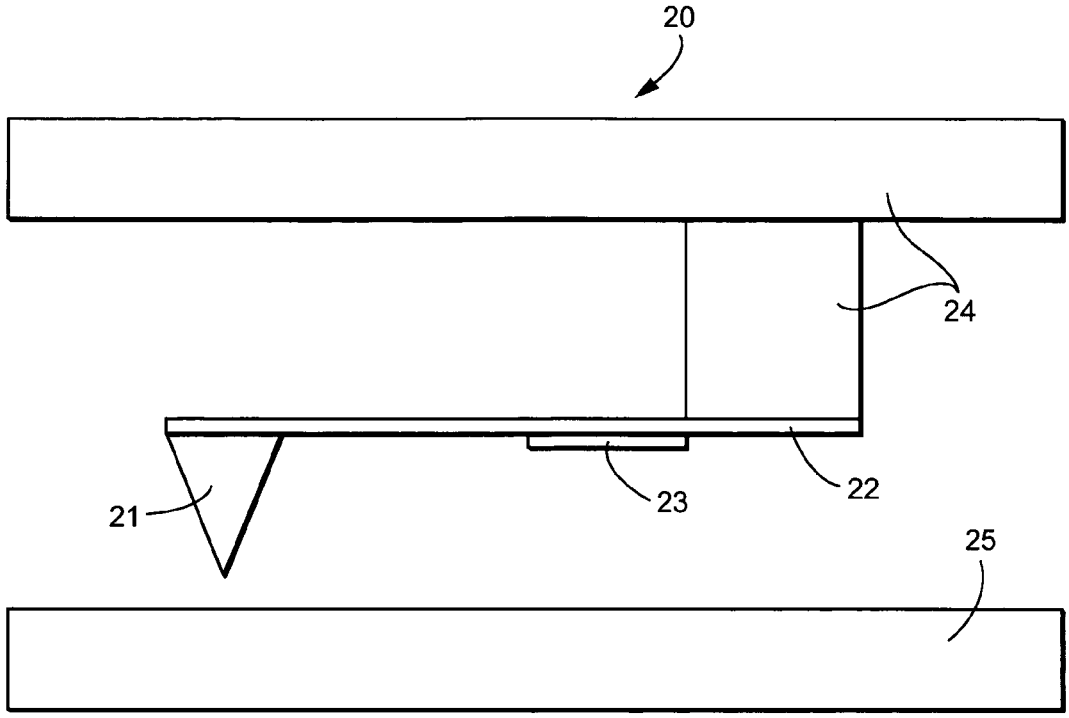
Fig. 3 (Prior Art)
FIG. 3 is a diagram of a basic prior art structure for a cantilever suspended tunneling tip.
Figure 4:
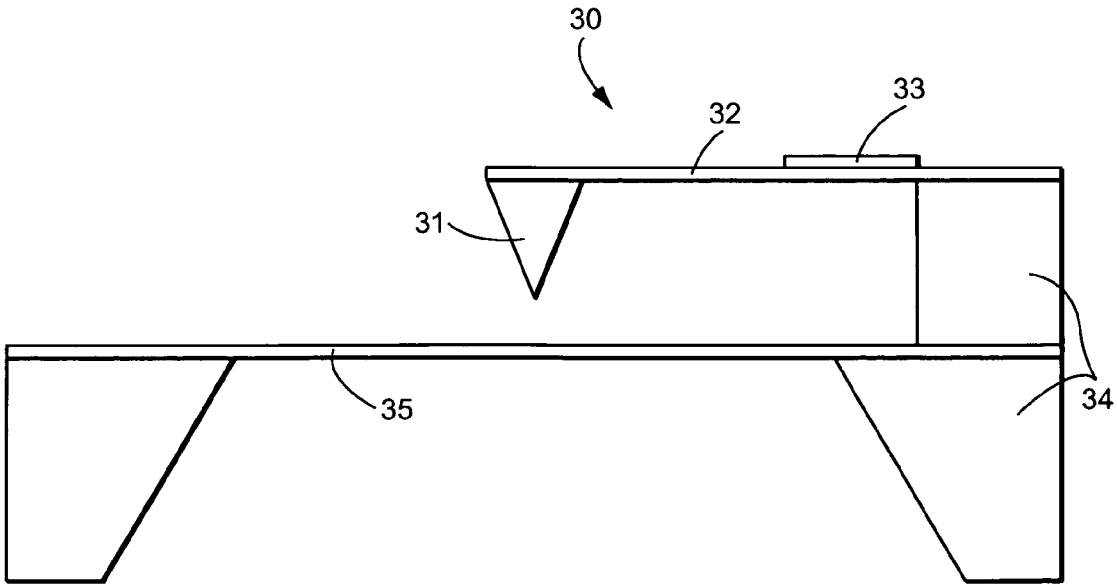
FIG. 4 is a diagram of a basic structure for an electron tunneling microphone.

In operation, an electrical potential or control voltage $V_m$ is applied between the membrane 42, which is conductive, and the control electrodes 45 on the rigid suspension plate 47. In addition, another electrical potential or voltage is applied between the tunneling tip 43 and the conductive membrane 42, and the resulting electrical current through the tunneling tip 43 is monitored. Typically, these voltages are in the range of 1 to 10 volts. As the membrane 42 is pulled towards the tunneling tip 43, at some point a tunneling current i will begin to flow in the tunneling tip 43. The control voltage $V_m$ is subsequently adjusted to achieve a given tunneling current in the tip 43, which is a steady-state condition. As the membrane 42 responds to differential acoustic pressure variations, it moves and therefore upsets the tunneling current i according to FIG. 2. In a feedback loop, the control voltage $V_m$ is instantly adjusted to return the membrane 42 to the steady-state condition. As a result, the constant adjustment of the control voltage $V_m$ is a direct measure of any sound pressure incident on membrane 42.

Figure 6:
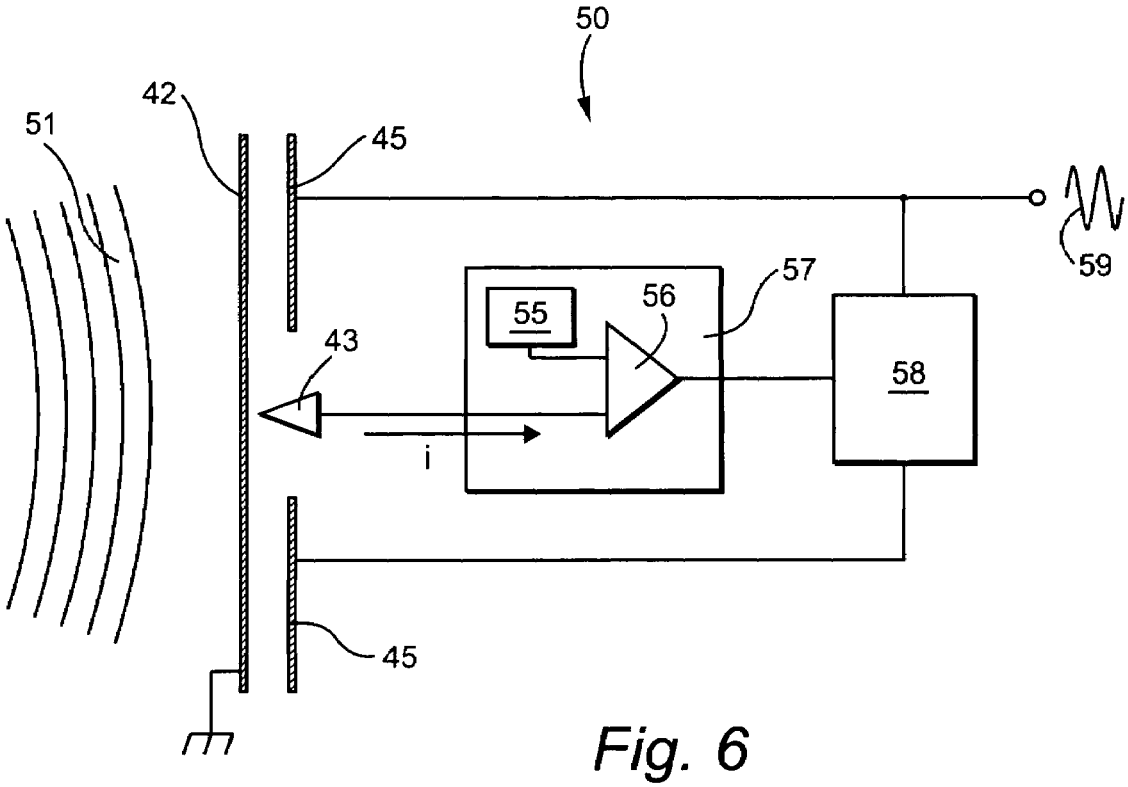
FIG. 6 is a block diagram of a control circuit used with the electron tunneling microphone of the present invention.

One embodiment of a circuit for achieving the required control function of the tunneling microphone 40 is the block diagram 50 shown in FIG. 6. The tunnel current monitor 57 includes an internal current reference 55 and a comparator 56, which compares the tunnel current i from the tunneling tip 43 to the internal current reference 55. The error signal of this comparison is fed to a current control electrode driver 58, which closes a feedback loop by driving the control electrodes 45 to maintain the steady-state position of the membrane 42 and electrodes 45 in the presence of acoustic sound pressure 51 incident on membrane 42. The control signal used by driver 58 to change the positions of electrodes 45 with respect to membrane 42 is also the microphone output signal 59.

Figure 7:
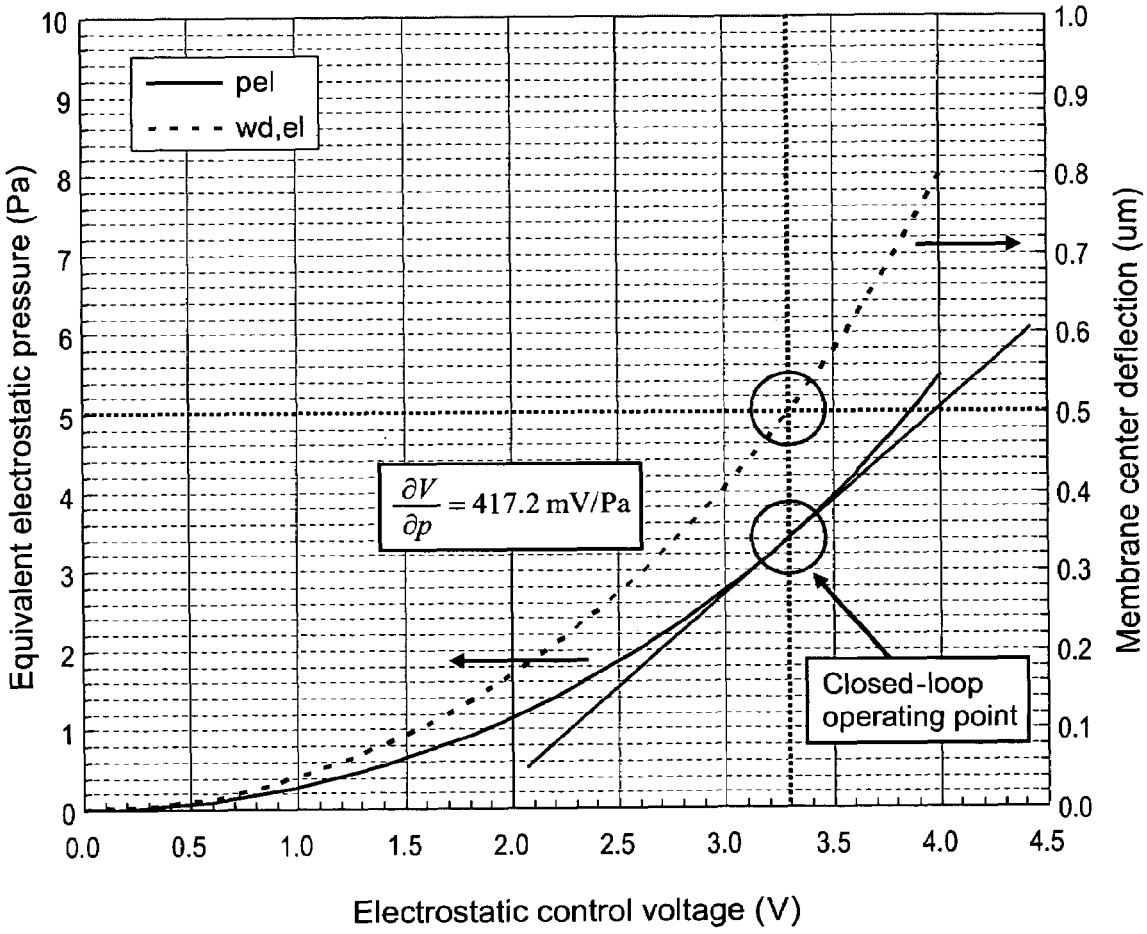
FIG. 7 is a graph showing the behavior of the electron tunneling microphone of the present invention.

A further explanation of the principle of operation of the microphone 40 of the present invention is shown in FIG. 7, which shows the internal relationships of an example tunneling microphone with a 500×500 μm membrane 42 with a thickness of 0.5 μm, and an initial gap between the membrane 42 and the tunneling tip 43 of 0.5 μm. The dashed line (wd,el) in FIG. 7 shows the relationship between applied control voltage $V_m$ and membrane deflection. In operation, a control voltage $V_m$ must be applied to bring the membrane 42 into close proximity to the tunneling tip 43. According to FIG. 7, this amounts to a control voltage $V_m$ of approximately 3.3 V. The solid line (pel) in FIG. 7 shows the pseudo-equivalent acoustic sound pressure as result of the applied control voltage $V_m$. According to FIG. 7, the equivalent sound pressure of a control voltage of 3.3 V is approximately 3.4 Pa. To maintain the membrane position at the closed-loop operating point, in response to an applied sound pressure, the control voltage must be adjusted. The amount of the adjustment is given by the slope of the line pel which is 417.2 mV/Pa. This is also the acoustic sensitivity of the tunneling microphone 40.

Figure 8A:
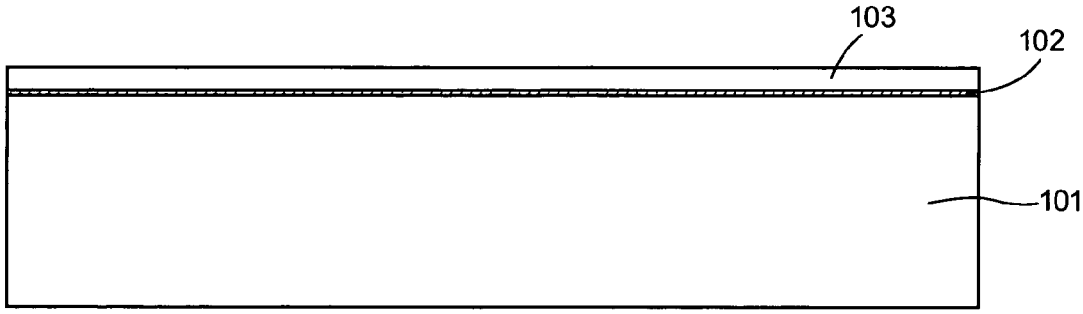
FIGS. 8*a* through 8*h* are cross-sectional diagrams of the electron tunneling microphone structure at various stages of a fabrication process according to the present invention.

A preferred fabrication process of the electron tunneling microphone according to the present invention is shown in FIGS. 8*a* through 8*h*. As shown in FIG. 8*a*, a silicon on insulator substrate with a device layer 103, a buried silicon dioxide layer 102, and a handle substrate layer 101 is used as a starting material to fabricate the tunneling microphone of the present invention. Alternatively, the device layer 103 can be formed on the silicon substrate using deep boron diffusion.

Figure 8B:
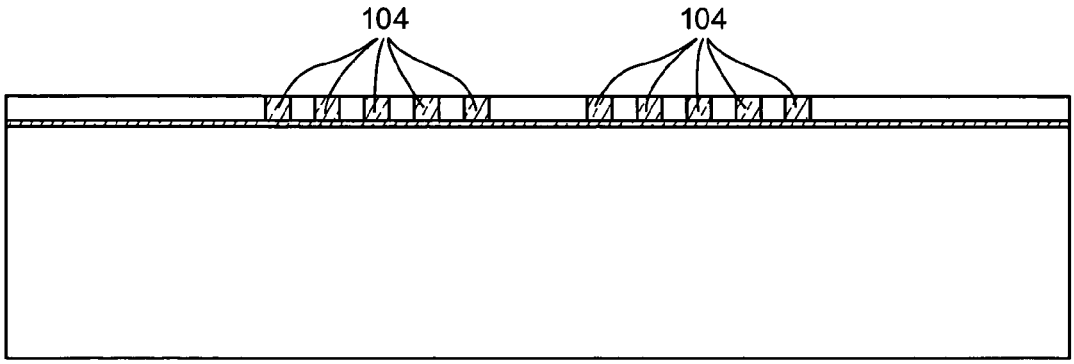

In FIG. 8*b*, a number of cavities 104 are etched in the device layer 103 using deep reactive ion etching (DRIE) and subsequently filled and planarized with a sacrificial material. A preferable sacrificial material is silicon dioxide. A preferable planarization technique is chemical mechanical polishing (CMP).

Figure 8C:
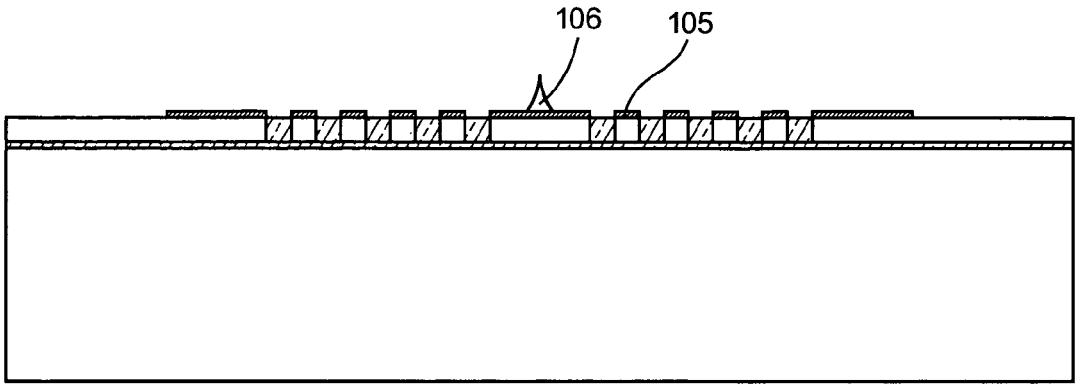

In FIG. 8*c*, control electrodes 105 and the tunneling tip 106 are then formed. Preferable materials for the control electrodes 105 and tunneling tip 106 include gold, palladium, platinum, chromium, and combinations thereof.

Figure 8D:
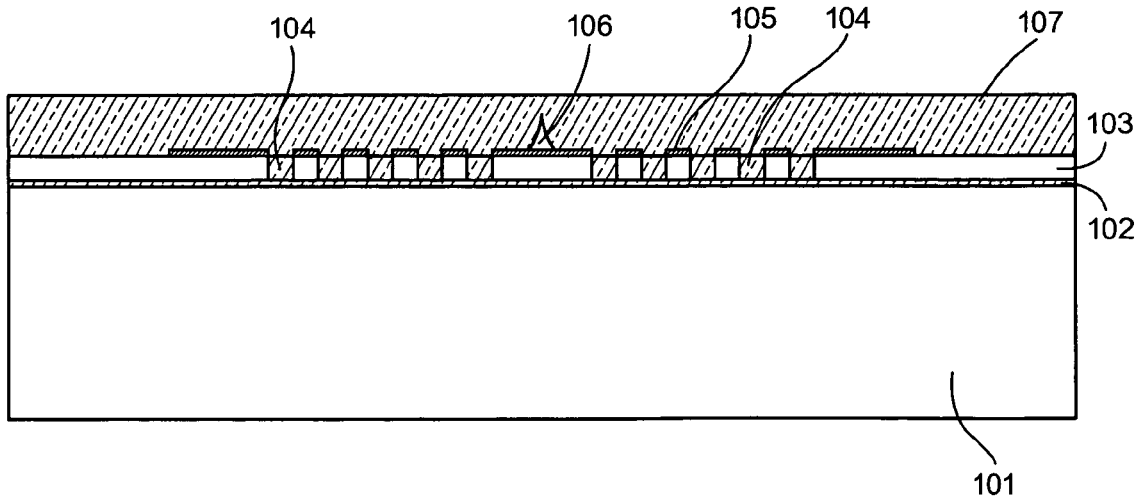

As shown in FIG. 8*d*, layer 107 of sacrificial material is subsequently deposited and planarized on top of the tunneling tip 106 and control electrodes 105. A preferable sacrificial material is silicon dioxide. A preferable planarization technique is chemical mechanical polishing (CMP).

Figure 8E:
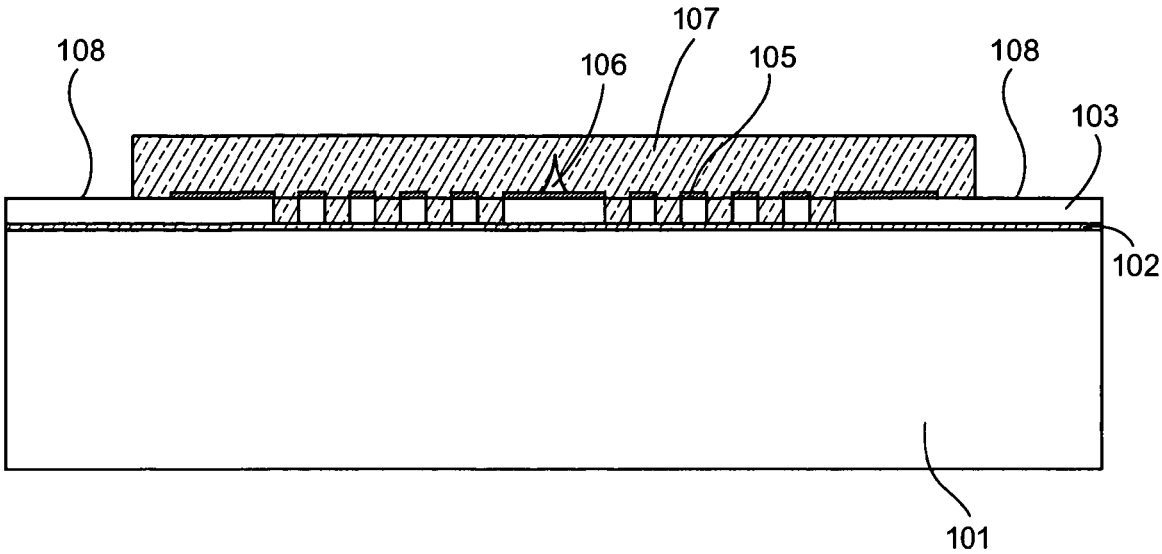
Figure 8F:
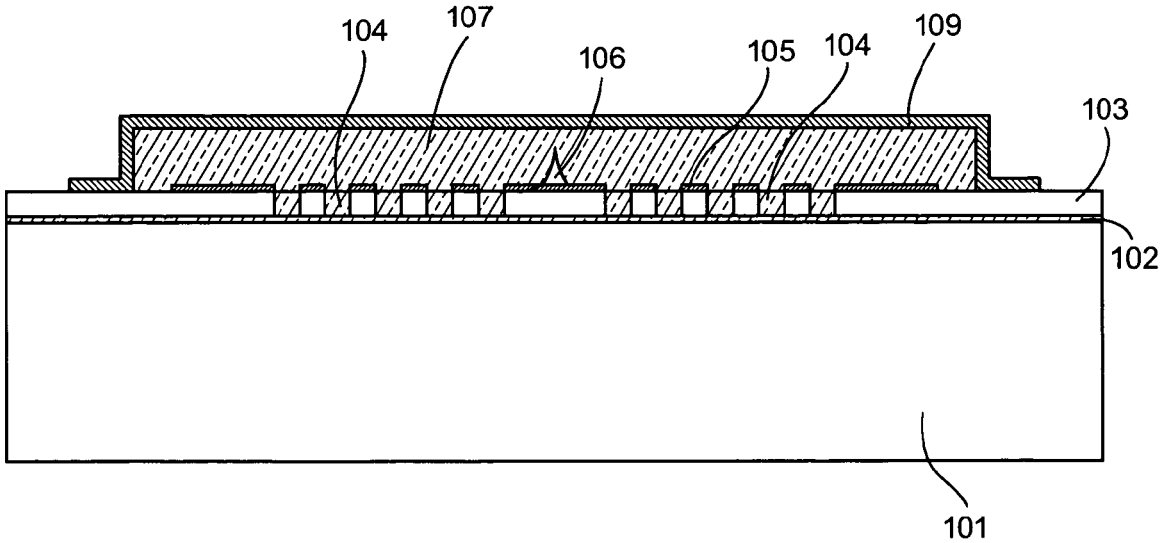

In FIG. 8*e*, sacrificial layer 107 is then removed in anchor areas 108, in which the membrane 109 will be attached to the support substrate 101. As shown in FIG. 8*f*, the membrane 109 is then formed on top of sacrificial layer 107 and anchor areas 108. Preferable materials for the membrane layer 109 include gold, palladium, platinum, chromium, silicon nitride, polycrystalline silicon and combinations thereof.

Figure 8G:
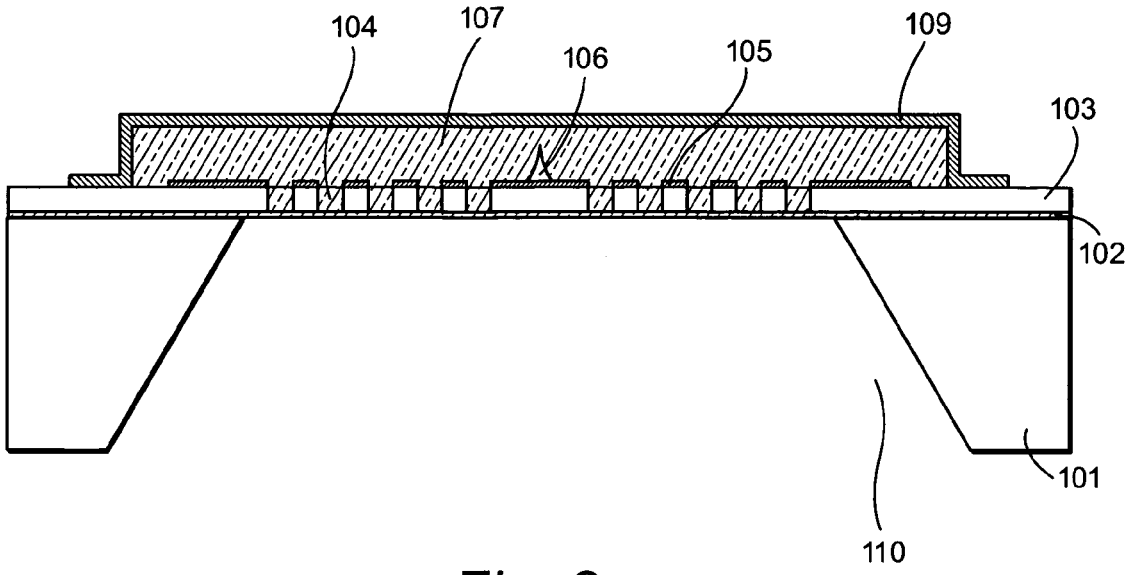
Figure 8H:
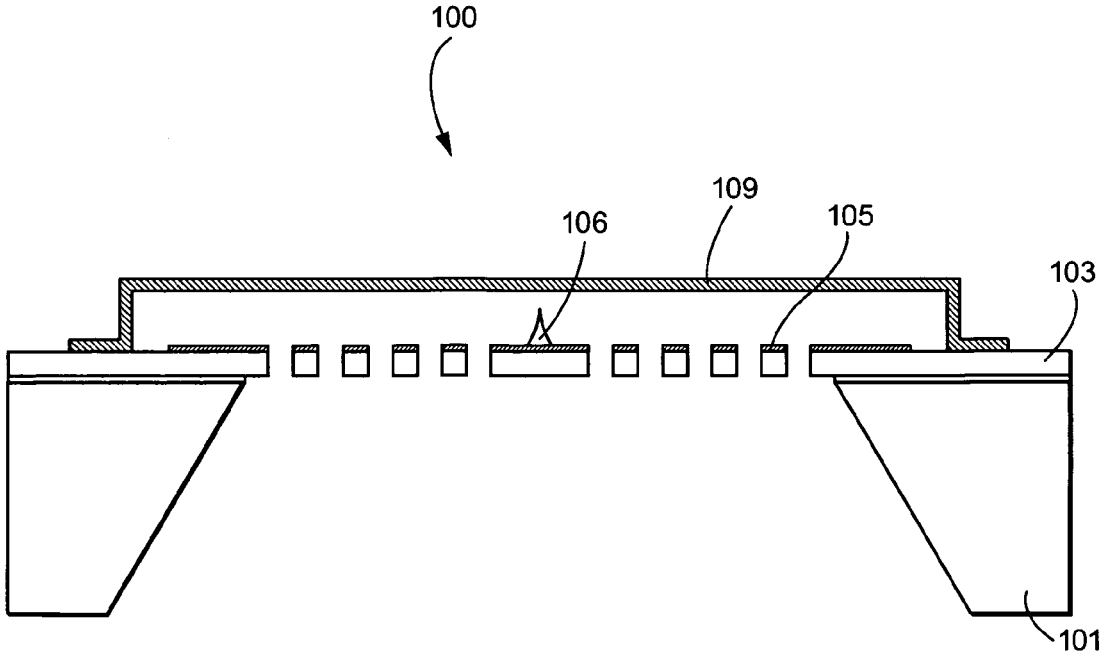

In FIG. 8*g*, the support substrate 101 is then etched from the back to form a cavity 110. Preferable methods for etching the support substrate 101 include potassium hydroxide (KOH) etching and deep reactive ion etching (DRIE). Finally, in FIG. 8*h*, all sacrificial layers are etched to form the tunneling microphone structure 100.

Although the present invention has been described in terms of a particular embodiment and process, it is not intended that the invention be limited to that embodiment and process. Modifications of the embodiment and process within the spirit of the invention will be apparent to those skilled in the art. The scope of the invention is defined by the claims that follow.

What is claimed is:

1. An acoustic detector comprising:

a substrate, a rigid plate supported by the substrate, a tunneling tip formed on the plate, a flexible membrane positioned over the tunneling tip and supported by the substrate, at least one electrode formed on the plate, and a control circuit for applying and adjusting a first electrical potential between the membrane and the at least one electrode to control and maintain the positioning of the membrane with respect to the tunneling tip in response to sound pressure incident upon the membrane, whereby adjustments of the first electrical potential by the control circuit is a measure of any sound pressure incident upon the membrane.

2. The acoustic detector of claim 1, wherein the control circuit applies a second electrical potential between the membrane and the tunneling tip to produce a current flow through the tunneling tip.

3. The acoustic detector of claim 2, wherein the control circuit is comprised of:

a current monitor for comparing the current flowing through the tunneling tip to a current reference, and a driver circuit for applying the first electrical potential to the at least one electrode, whereby the driver circuit adjusts the first electrical potential based on the comparison of the tunneling tip current to the reference current to either maintain the position of the membrane with respect to the tunneling tip or to move the membrane into closer or farther proximity with the tunneling tip.

4. The acoustic detector of claim 3, wherein the control circuit adjusts the second electrical potential to produce a steady-state current in the tunneling tip, and wherein the control circuit further comprises a feedback loop for adjusting the first electrical potential to move the membrane when it responds to acoustic pressure variations incident upon it to thereby return to the steady-state current in the tunneling tip.

5. The acoustic detector of claim 1, wherein the membrane is pressure sensitive and conductive.

6. The acoustic detector of claim 1, wherein the plate includes a plurality of openings in it to allow air in a gap between the membrane and plate to escape, whereby viscous damping and associated noise in the acoustic detector are reduced.

7. The acoustic detector of claim 1, wherein the tunneling tip and the at least one electrode are made from at least one metal that will not react with the ambient in which the acoustic detector is placed.

8. The acoustic detector of claim 1, wherein the tunneling tip and the at least one electrode are made from one or more materials selected from the group consisting of gold, platinum, palladium, and chromium.

9. The acoustic detector of claim 1, wherein the membrane is made from one or more materials selected from the group consisting of gold, platinum, palladium, and chromium.

10. The acoustic detector of claim 9, wherein the membrane is reinforced with a dielectric or semi-conducting material for mechanical support.

11. The acoustic detector of claim 9, wherein the membrane is reinforced with a material selected from the group consisting of silicon, polycrystalline silicon, silicon nitride, and silicon dioxide.

12. The acoustic detector of claim 1, wherein the substrate and the plate are made from one or more materials selected from the group consisting of silicon, silicon nitride, and silicon dioxide.

13. The acoustic detector of claim 1, wherein application by the control circuit of the first electrical potential between the at least one control electrode and the membrane causes the membrane to bend towards the at least one electrode, and hence the tunneling tip, due to electrostatic attraction.

14. An electron surface tunneling acoustic detector comprising:

a support substrate, a rigid perforated suspension plate supported by the substrate, a tunneling tip formed on the suspension plate, a conductive pressure sensitive membrane mounted on the substrate over the tunneling tip, a plurality of control electrodes formed on the suspension plate, and a control circuit for applying an electrical potential to between the membrane and the control electrodes to control movement of the membrane and thereby maintain the membrane in a steady state position with respect to the tunneling tip, whereby adjustments to the electrical potential by the control circuit is a measure of sound pressure incident upon the membrane.

15. The acoustic detector of claim 14 wherein the control circuit is comprised of:

a current monitor for comparing to an internal current reference current flowing through the tunneling tip, and a control electrode driver for applying the electrical potential between the membrane and control electrodes, whereby the control electrode driver in response to an error signal based on the comparison of the tip current to the reference current either maintains the position of the conductive membrane or move the membrane into closer or farther proximity with the tunneling tip.

16. A method of fabricating an electron surface tunneling acoustic detector comprising the steps of:

forming on a silicon substrate a handle substrate layer, a buried silicon dioxide layer, and a device layer, etching a plurality of cavities in the device layer, and subsequently filling and planarizing the cavities with a sacrificial material, forming a plurality of electrodes and a tunneling tip on the device layer, depositing and planarizing on top of the tunneling tip and plurality of electrodes a layer of sacrificial material, removing the layer of sacrificial material in a plurality of anchor areas in which a membrane will be attached to the support substrate, forming on top of the remaining sacrificial layer and anchor areas the membrane, etching the support substrate from its back to form a cavity, and etching all sacrificial layers to form the tunneling acoustic detector.

17. The method of claim 16, wherein the device layer is formed on the silicon substrate using deep boron diffusion.

18. The method of claim 16, wherein the plurality of cavities are etched in the device layer using deep reactive ion etching.

19. The method of claim 16, wherein the sacrificial material formed on top of the tunneling tip and plurality of electrodes is silicon dioxide, and wherein the sacrificial material is planarized using chemical mechanical polishing.

20. The method of claim 16, wherein the control electrodes and the tunneling tip are made from one or more materials selected from the group consisting of gold, palladium, platinum, and chromium.

21. The method of claim 16, wherein the membrane layer is made from one or more materials selected from the group consisting of gold, palladium, platinum, chromium, silicon nitride, and polycrystalline silicon.

22. The method of claim 16, wherein the method for etching the support substrate is selected from the group consisting of potassium hydroxide etching and deep reactive ion etching.

* * * * *